United States Patent [19]

Fister

[11] 4,101,860

[45] Jul. 18, 1978

[54] PROTECTOR FOR ELECTRIC CIRCUITS

[75] Inventor: Aloysius J. Fister, St. Louis, Mo.

[73] Assignee: McGraw-Edison Company, Elgin, Ill.

[21] Appl. No.: 688,552

[22] Filed: May 20, 1976

[51] Int. Cl.[2] ..... H01H 85/10

[52] U.S. Cl. ..... 337/159; 337/290

[58] Field of Search ..... 337/158–166, 337/186, 187, 273, 276, 280, 282, 290, 291, 295

[56] References Cited

U.S. PATENT DOCUMENTS

| | | | |
|---|---|---|---|
| 2,682,587 | 6/1954 | Burt et al. | 337/295 |
| 2,833,891 | 5/1958 | Jacobs | 337/158 |
| 2,982,835 | 5/1961 | Kozacka | 337/158 |
| 3,291,942 | 12/1966 | Kozacka | 337/163 |
| 3,394,333 | 7/1968 | Jacobs | 337/229 |
| 3,938,067 | 2/1976 | Fister | 337/159 |

*Primary Examiner*—Harold Broome

*Attorney, Agent, or Firm*—Jon Carl Gealow; Thomas E. McDonald; Ronald J. LaPorte

[57] ABSTRACT

The fusible element of a single-element, dual-function, electric fuse is disposed within a passage within a housing of inorganic ceramic material which has a high thermal conductivity; and the major portion of that fusible element is displaced radially from the axis of that passage to be in intimate heat-transferring relation with one side of that passage. Two of the "weak spots" of that fusible element are in close heat-transferring relation with the terminals of that electric fuse; and a portion of that fusible element which is intermediate those two weak spots is in intimate heat-transferring relation with the opposite side of that passage. The resulting transference of heat from that fusible element to that passage enables those two weak spots to continuously carry the rated current of that fusible element even though those two weak spots have very small cross sections, and hence are able to provide desirable current-interrupting action.

15 Claims, 9 Drawing Figures

PROTECTOR FOR ELECTRIC CIRCUITS

BACKGROUND OF THE INVENTION

Some electric fuses have fusible elements which perform only one function, whereas other electric fuses have fusible elements which perform dual functions. One example of an electric fuse that has a fusible element which performs only one function is an electric fuse that is connected in series relation with a circuit breaker; and the only function to be performed by the fusible element of such an electric fuse is to open the circuit in response to a heavy overcurrent or short circuit. Another example of an electric fuse that has a fusible element which performs only one function is an electric fuse which has a spring-biased connector or a large mass of solder that can respond to a prolonged low overcurrent to open the circuit; and the only function to be performed by the fusible element of such an electric fuse is to open the circuit on a heavy overcurrent or short circuit. One example of an electric fuse that has a fusible element which performs a dual function is a renewable electric fuse that has a fusible element which is able to open the circuit in response to a prolonged low overcurrent or to a heavy overcurrent or short circuit. Another example of an electric fuse that has a fusible element which performs a dual function is an electric fuse that has a silver or copper fusible element with a mass of tin riveted or bonded to it. An electric fuse which has a spring-biased connector or a large mass of solder that can respond to a prolonged low overcurrent to open the circuit is referred to as a dual-element electric fuse, and, similarly, an electric fuse that has a silver or copper fusible element with a mass of tin riveted or bonded to it is referred to as a dual-element electric fuse.

SUMMARY OF THE INVENTION

The present invention provides a single-element, dual-function electric fuse that has the fusible element thereof disposed within a passage within a housing of inorganic ceramic material which has a high thermal conductivity, the major portion of that fusible element is displaced radially from the axis of that passage to be in intimate heat-transferring relation with one side of that passage, two of the "weak spots" of that fusible element are in close heat-transferring relation with the terminals of that electric fuse, and a portion of that fusible element which is intermediate those two weak spots is in initimate heat-transferring relation with the opposite side of that passage. It is, therefore, an object of the present invention to dispose the major portion of the length of the fusible element of a single-element, dual-function, electric fuse in intimate heat-transferring relation with one side of a passage within a housing of inorganic ceramic material which has a high thermal conductivity, to dispose two of the "weak spots" of that fusible element in close heat-transferring relation with the terminals of that electric fuse, and to dispose a portion of that fusible element which is intermediate those two weak spots in intimate heat-transferring relation with the opposite side of that passage.

The portion of the fusible element which is in initimate heat-transferring relation with the opposite side of the passage is a re-entrant bend that interconnects two portions of that fusible element which are bent away from the one side of that passage and pass through the axis of that passage to closely approach that opposite side of that passage. The re-entrant bend and the bends at the opposite ends of those two portions accommodate heat-induced elongation of the fusible element; and hence the very small cross section weak spots of the fusible element are not subjected to destructive stresses due to heat-induced elongation of that fusible element. It is, therefore, an object of the present invention to bend two portions of a fusible element away from one side of a passage within a housing that is made from an inorganic ceramic material which has a high thermal conductivity to form a re-entrant bend that is in intimate heat-tranferring relation with the opposite side of that passage.

The cross section of the passage should be small enough so the arc-quenching filler material can transfer to the surface of that passage appreciable amounts of the heat which it absorbs from the fusible element; and yet that cross section must be large enough to permit the weak spots of that fusible element to be embedded by enough arc-quenching filler material to ensure prompt and full quenching of any arc which may form as that fusible element fuses. As a result, the cross section of the passage should be from three hundred to thirty-six hundred times as large as the cross section of the smallest weak spot of the fusible element. It is, therefore, an object of the present invention to make the cross section of a passage, within a housing which has a high thermal conductivity, so it is from three hundred to thirty-six hundred times as large as the cross section of the smallest weak spot of the fusible element.

A heat-absorbing arc-quenching filler material contacts and embeds the major portion of the length of the fusible element and one of the two weak spots of very small cross section; and a heat-insulating arc-quenching filler material contacts and embeds the other of the two weak spots of very small cross section. The other of the two very small cross section weak spots is dimensioned so it will respond to a low but potentially-hurtful overcurrent to generate more heat than the adjacent terminal and the heat-insulating arc-quenching filler material can absorb, and hence will fuse prior to or simultaneously with the fusing of the one very small cross section weak spot. It is, therefore, an object of the present invention to contact and embed the major portion of the length of a fusible element and one of the two weak spots of very small cross section thereof with a heat-absorbing arc-quenching material, to contact and embed the other of the two weak spots of very small cross section of that fusible element with a heat-insulating arc-quenching filler material, and to dimension that other weak spot of very small cross section so it will respond to a low but potentially-hurtful overcurrent to generate more heat than the adjacent terminal and the heat-insulating arc-quenching filler material can absorb, and hence will fuse prior to or simultaneously with the fusing of the one very small cross section weak spot.

Other and further objects and advantages of the present invention should become apparent from an examination of the drawing and accompanying description.

In the drawing and accompanying description a plurality of preferred embodiments of the present invention are shown and described but it is to be understood that the drawing and accompanying description are for the purpose of illustration only and do not limit the invention and that the invention will be defined by the appended claims.

DETAILED DESCRIPTION OF THE PREFERRED EMBODIMENT OF FIGS. 1-5

Figure 1:
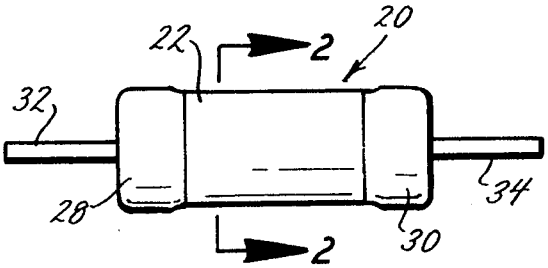
FIG. 1 is a side elevational view of one preferred embodiment of electric fuse which is made in accordance with the principles and teachings of the present invention.

Referring to FIGS. 1-5 in detail, the numeral 20 denotes one preferred embodiment of electric fuse which is made in accordance with the principles and the teachings of the present invention. That electric fuse has a housing 22 of insulating material which has a passage 23 therethrough. That housing is made from an inorganic ceramic material which has a thermal conductivity greater than seven thousandths of a calorie per square centimeter of cross section per centimeter of length per second of time per degree centigrade. Some inorganic ceramic materials which have such a thermal conductivity are aluminum oxide, beryllium oxide, boron nitride, steatite, mullite and cordierite. Aluminum oxide is preferred because it has a very high thermal conductivity and because it is sturdy. Annular grooves 24 and 26 are formed in the outer surface of that housing adjacent the ends thereof.

A ferrule-like terminal 28 is telescoped over the left-hand end of the housing 22; and that terminal has the free edge of the rim thereof deformed into the annular groove 24. A yieldable annular seal 29, of the type disclosed in Fister U.S. Pat. No. 3,644,861, is disposed within the groove 24 before the free edge of the rim of terminal 28 is telescoped over and deformed into that groove. The numeral 30 denotes a ferrule-like terminal which is telescoped over the right-hand end of the housing 22; and that terminal has the free edge of the rim thereof deformed into the annular groove 26. A yieldable annular seal 31, of the type disclosed in said Fister patent, is disposed within that groove before the free edge of the rim of that terminal is telescoped over and deformed into that groove. A knife blade 32 is permanently secured to and made a part of the terminal 28; and a knife blade 34 is permanently secured to and made a part of the terminal 30.

The numeral 36 generally denotes an elongated fusible element which has the left-hand end thereof mechanically secured and electrically bonded to the terminal 28 by a mass of solder, not shown, and which has the right-hand end thereof mechanically secured and electrically bonded to the terminal 30 by a mass of solder, not shown. As shown particularly by FIG. 4, that fusible element has a reduced cross section portion 38 which constitutes a weak spot, has two reduced cross-section portions 40 which constitute a weak spot, has two other reduced cross-section portions 42 which constitute a weak spot, has two further reduced cross-section portions 44 which constitute a weak spot, has two additional reduced cross-section portions 46 which constitute a weak spot, and has yet another reduced cross-section portion 48 which constitutes a weak spot. The fusible element 36 has a constant thickness; and hence the cross sectional areas of the various weak spots are functions of the widths of those weak spots. The weak spots 38 and 48 have substantially the same widths; and the width of each of those weak spots is considerably less than the combined width of any two of the reduced cross-section portions which constitute the weak spots 40, 42, 44 and 46.

In one preferred embodiment of the present invention, the diameter of the passage 23 is six hundred and seventy-three thousandths of a centimeter, the width of each end of the fusible element 36 is five hundred and forty-six thousandths of a centimeter, the width of each weak spot 38 and 48 is thirty-eight thousandths of a centimeter, the width of each reduced cross-section portion 40, 42, 44 and 46 is forty-seven thousandths of a centimeter and hence the width of each weak spot 40, 42, 44 and 46 is ninety-four thousandths of a centimeter, and the thickness of that fusible element ranged from thirty-eight ten-thousandths of a centimeter to one hundred and twenty-seven ten-thousandths of a centimeter. Also, that fusible element is made of silver.

Figure 3:
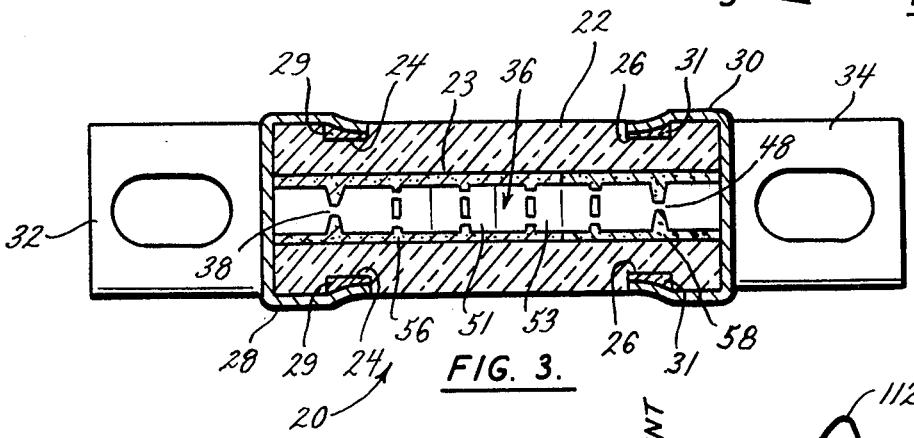
FIG. 3 is a sectional view, on the scale of FIG. 2, through the electric fuse of FIG. 1, and it is taken along the plane indicated by the line 3—3 in FIG. 2.
Figure 4:
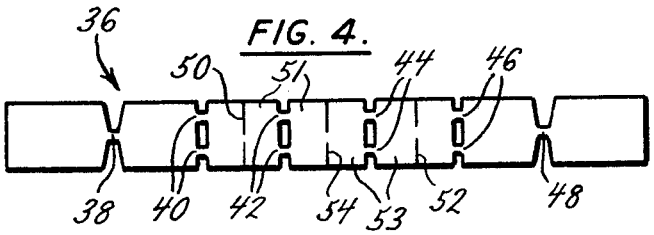
FIG. 4 is a plan view, on a still larger scale, of one preferred embodiment of fusible element which is usable in the electric fuse of FIG. 1.
Figure 5:
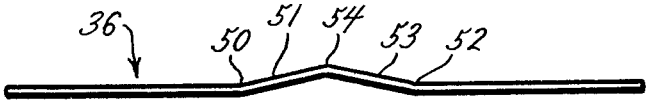
FIG. 5 is a side elevational view, on the scale of FIG. 4, of the fusible element of FIG. 4.

As shown by FIG. 4, the left-hand axially-outer section of fusible element 36 includes weak spot 38 and the reduced cross-section portions 40, and the right-hand axially-outer section of that fusible element includes weak spot 48 and the reduced cross-section portions, 46; and those axially-outer sections coact to define a plane. As shown by FIG. 2, that plane is displaced radially from the axis of the passage 23 to be immediately adjacent one side of that passage. As shown by FIGS. 4 and 5, the fusible element 36 has a transversely-directed bend 50 therein which causes a portion 51 of that fusible element to incline away from the plane which is defined by the axially-outer sections and to pass through and beyond the axis of the passage 23 to dispose a part thereof immediately adjacent the opposite side of that passage. That fusible element has a further transversely-directed bend 52 which causes a portion 53 of that fusible element to bend away from that plane and to pass through and beyond the axis of the passage 23 to dispose a part thereof immediately adjacent that opposite side of that passage. The bend 50 causes the portion 51 to coact with the left-hand axially-outer section of fusible element 36 to subtend an angle of from 140° to 160°;and the bend 52 causes the portion 53 to coact with the right-hand axially-outer section of that fusible element to subtend an angle of from 140° to 160°. A re-entrant bend 54 interconnects the adjacent ends of the portions 51 and 53; and that re-entrant bend is immediately adjacent that opposite side of that passage. In the preferred embodiment of FIGS. 1-5, the elongated edges of the axially-outer sections of the fusible element 36 are in intimate heat-transferring relation with the one side of the passage 23, and the re-entrant bend 54 is in intimate heat-transferring relation with the opposite side of that passage. In fact, portions of those elongated edges preferably will directly touch that one side and portions of that re-entrant bend will directly touch that opposite side even when all portions of that fusible element are at the ambient temperature level. Direct engagement between portions of the elongated edges of the axially-outer sections of fusible element 36 and the one side of passage 23 and direct engagement between portions of the re-entrant bend 54 and the opposite side of that passage can easily be assured by making that fusible element long enough so the terminals 28 and 30 will apply inwardly-directed axial forces to that fusible element which will force the re-entrant bend 54 to engage that opposite side and thereby force those portions of those elongated edges to engage that one side.

It will be noted that the weak spots 42 and 44 are close to, but are oppositely disposed of, the re-entrant bend 54; and hence heat from those weak spots will flow to that re-entrant bend. Because portions of that re-entrant bend are in intimate heat-transferring relation with the opposite side of the passage, appreciable portions of that heat will be transferred to the housing 22. As a result, the cross sections of the weak spots 42 and 44 can be made smaller than they would have to be made if portions of the re-entrant bend 54 were not in intimate heat-transferring relation with that opposite side of that passage.

It should also be noted that the weak spots 42 and 44 are spaced inwardly from the elongated edges of the fusible element 36. Similarly, it should be noted that the weak spots 38, 40, 46 and 48 also are spaced inwardly from those elongated edges. Such spacing is important; because it enables all of those weak spots to respond to a heavy overcurrent or to a short circuit to fuse promptly even though portions of the elongated edges of the axially-outer sections and portions of the re-entrant bend are in intimate heat-transferring relation with the sides of the passage.

Because the cross section of each of the weak spots 38 and 48 is much smaller than the cross section of any of the weak spots 40, 42, 44 and 46, the mechanical strength and bending resistance of each of the weak spots 38 and 48 are less than those of any of the weak spots 40, 42, 44 and 46. However, the present invention effectively avoids any bending of either of the weak spots 38 and 48 by locating them in the axially-outer sections of the fusible element 36 and by providing the bends 50, 52 and 54 in that fusible element. The locating of those weak spots in those axially-outer sections helps minimize radial displacement or deflection of those weak spots, because the immediately-adjacent surface of the passage 23 limits radial displacement or deflection of those axially-outer sections; and those bends will accommodate any temperature-induced elongation of the fusible element which would tend to cause the weak spots 38 and 48 to deflect or be displaced radially.

After the terminal 28 has been telescoped over and secured to the left-hand end of the housing 22, a heat-absorbing arc-quenching filler material 56 is introduced into the passage 23 to directly contact and embed the weak spots 38, 40, 42 and 44. Various heat-absorbing arc-quenching filler materials could be used, but quartz sand has been found to be very useful. Thereafter, a heat-insulating arc-quenching filler material 58 is introduced into that passage to contact and embed the weak spot 48. Various heat-insulating arc-quenching filler materials could be used, but calcium sulphate has been found to be very useful. The heat-insulating arc-quenching filler material 58 is shown contacting and embedding the weak spot 46 as well as the weak spot 48; and that is done to make sure that enough heat-insulating arc-quenching filler material is introduced into the passage 23 to completely and fully contact and embed the weak spot 48 plus any portions of the fusible element 36 which will fuse because that weak spot fuses.

The cross sectional area of the passage 23 is thirty-five hundred and fifty-eight ten thousandths of a square centimeter. When the thickness of fusible element 36 is one hundred and twenty-seven ten thousandths of a centimeter, the cross section of weak spot 38 or 48 is forty-eight one hundred thousandths of a square centimeter; and the ratio of the cross section of passage 23 to that of either of those weak spots is 735 to 1. When the thickness of that fusible element is thirty-eight ten thousandths of a centimeter, the cross section of weak spot 38 or 48 is fourteen one hundred thousandths of a square centimeter; and the ratio of the cross section of passage 23 to that of either of those weak spots is twenty-four hundred and fifty-one to one. If desired, the ratio of the cross section of the passage 23 to the cross section of the weak spot 38 or 48 could be made as small as three hundred or as large as thirty-six hundred to one; because ratios within that range enable the arc-quenching filler material 56 to transfer appreciable amounts of the heat, which it absorbs from the fusible element 36, to the surface of the passage 23, and enables that arc-quenching filler material to coact with the arc-quenching filler material 58 to ensure prompt and full quenching of any arc which may form as the fusible element 36 fuses.

Whenever current flows through the electric fuse 20, the fusible element 36 will respond to that current to generate heat. The resulting increase in the temperature of that fusible element will cause it to elongate. Because the terminals 28 and 30 will keep the ends of that fusible element from moving further away from each other, the temperature-induced elongation of the axially-outer sections of that fusible element will force the bends 50 and 52 to move closer to each other. The portions 51 and 53 of that fusible element also will elongate; and hence the overall result is that the opposite ends of the bends 50 and 52 and of the re-entrant bend 54 will be forced into very intimate engagement with the surface of the passage 23. That very intimate engagement is desirable because it will further enhance the transference of heat from the fusible element 36 to the surface of the passage 23.

The cross section of each of the weak spots 38 and 48 is less than the cross section of any of the weak spots 40, 42, 44 and 46; and hence each of the weak spots 38 and 48 will generate more heat than will any of the weak spots 40, 42, 44 and 46. However, because the weak spots 38 and 48 are respectively close to, and in heat-transferring relation with, the terminals 28 and 30, appreciable percentages of the heat generated by those weak spots will be conducted to those terminals for transfer to the external circuit. A further percentage of the heat generated by the weak spots 38 and 48 and a percentage of the heat generated by the weak spots 40, 42, 44 and 46 will be transferred to the surface of the passage 23 through the elongated edges of the axially-outer sections of fusible element 36 which are in heat-transferring relation with that passage, a further percentage of the heat generated by the weak spots 42 and 44 will be transferred to the surface of the passage 23 through the ends of the re-entrant bend 54 which are in heat-transferring relation with that passage, and further percentage of the heat generated by the weak spots 40 and 46 and still further percentages of the heat generated by the weak spots 38, 42, 44 and 48 will be transferred to the surface of the passage 23 through the arc-extinguishing filler materials 56 and 58. Because the filler material 56 is heat-absorbing arc-extinguishing filler material whereas the filler material 58 is a heat-insulating arc-extinguishing filler material, the former arc-extinguishing filler material will absorb more heat per unit length of the fusible element 36 than will the latter arc-extinguishing filler material. The transfer of heat from that fusible element to the surface of the passage 23 via the elongated edges of the axially-outer sections of that fusible element and via the ends of the re-entrant bend 54 is particularly important; and it significantly contributes to the ability of the weak spots 38 and 48 to remain intact, despite the very small cross sections thereof, as the rated current of the electric fuse 20 flows through the fusible element 36.

If a low but potentially-hurtful overcurrent flows through the electric fuse 20 for a predetermined length of time, the terminal 30, the portion of the surface of passage 23 which is in intimate heat-transferring relation with the elongated edges of the right-hand axially-outer section of fusible element 36, and the heat-insulating arc-extinguishing filler material 58 will be unable to absorb heat from that fusible element at a rate which is sufficient to keep the weak spot 48 from fusing. As a result, that weak spot will fuse at the end of that predetermined length of time, to open the circuit of which that electric fuse is a part. The weak spot 38 may fuse simultaneously with, or shortly after, the fusing of the weak spot 48; but it will not fuse prior to the fusing of weak spot 48. This is desirable because the arc-quenching filler material 58 will remain non-conductive in the presence of any arc which may form as the weak spot 48 fuses. Moreover, where that arc-quenching filler material is calcium sulphate, it will evolve arc-quenching vapor as it is heated during the fusing of the weak spot 48. The electric fuse 20 is able to open the circuit of which it is a part in response to an overcurrent which is as small as 120 percent of the rated current of that electric fuse.

It will be noted that the fusible element 36 is wholly devoid of an alloying material, in the form of a rivet or overlay, which could respond to heating of that fusible element to alloy with the material of that fusible element. This is important, because it enables the weak spots of that fusible element to have cross sections which are much smaller than they would have to be if that fusible element was provided with such an alloying material. The very small cross sections which the weak spots of fusible element 36 can have, because that fusible element is wholly devoid of an alloying material in the form of a rivet or overlay, enable that fusible element to ensure prompt and full opening of the circuit in response to a low but potentially-harmful overcurrent.

If a short circuit were to develop in the electric circuit of which the electric fuse 20 was a part, the weak spots 38 and 48 would fuse immediately. The weak spots 40, 42, 44 and 46 would fuse almost simultaneously with the weak spots 38 and 48. As a result, full and prompt opening of the circuit would be ensured.

Figure 7:
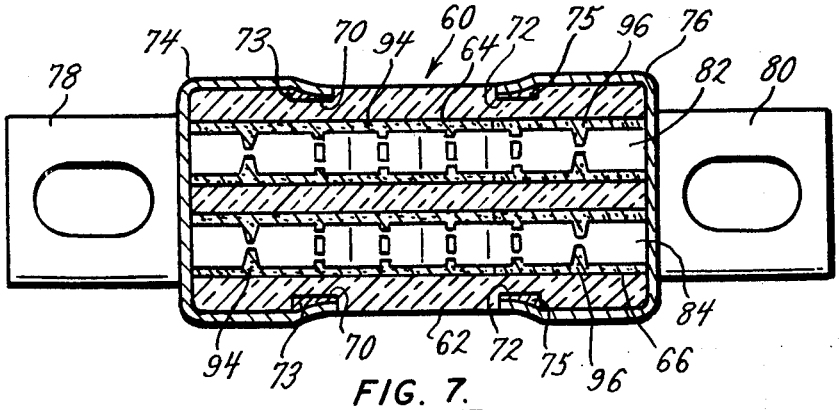
FIG. 7 is a sectional view through the electric fuse of FIG. 6, and it is taken along the plane indicated by the line 7—7 in FIG. 6.
Figure 6:
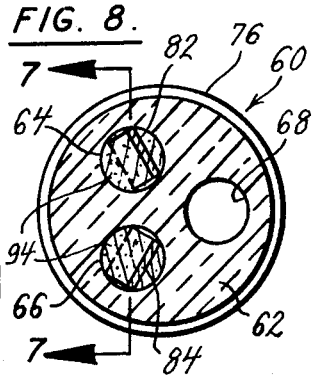
FIG. 6 is a sectional view through a second preferred embodiment of electric fuse which is made in accordance with the principles and teachings of the present invention.

Referring to FIGS. 6 and 7 in detail, the numeral 60 generally denotes a second preferred embodiment of electric fuse which is made in accordance with the principles and teachings of the present invention. That electric fuse has a housing 62 of insulating material which has three passages 64, 66 and 68 therethrough; and the diameter of each of those passages is equal to the diameter of the passage 23 in the housing 22 of FIGS. 1–5. The axes of the three passages 64, 66 and 68 are parallel to each other and are parallel to the geometric axis of the housing 62. That housing is made from an inorganic ceramic material which has a thermal conductivity greater than seven thousandths of a calorie per square centimeter of cross section per centimeter of length per second of time per degree centigrade. Some inorganic ceramic materials which have such a thermal conductivity are aluminum oxide, beryllium oxide, boron nitride, steatite, mullite and cordierite. Aluminum oxide is preferred because it has a very high thermal conductivity and because it is sturdy. Annular grooves 70 and 72 are formed in the outer surface of the housing 62 adjacent the ends thereof.

A ferrule-like terminal 74 is telescoped over the left-hand end of the housing 62; and that terminal has the free edge of the rim thereof deformed into the annular groove 70. A ferrule-like terminal 76 is telescoped over the right-hand end of the housing 62; and that terminal has the free edge of the rim thereof deformed into the annular groove 72. Annular seals 73 and 75 of yieldable material are disposed, respectively, within the grooves 70 and 72 before the free edges of the rims of the terminals 74 and 76 are telescoped over and deformed into those annular grooves. A knife blade 78 is secured to and made a part of the terminal 74; and the knife blade 80 is secured to and made a part of the terminal 76.

The numerals 82 and 84 denotes fusible elements which are disposed within the passages 64 and 66 of the housing 62. Masses of solder, not shown, secure the left-hand ends of the fusible elements 82 and 84 to the terminal 74; and further masses of solder, not shown, secure the right-hand ends of those fusible elements to the terminal 76. The fusible elements 82 and 84 preferably are substantially identical to the fusible element 36—being completely identical in some ampere ratings, and having different thicknesses in other ampere ratings. For example, the thickness of the fusible element 36 of a 35 ampere rated electric fuse 20 can be exactly the same as the thickness of each of the fusible elements 82 and 84 of a 70 ampere rated electric fuse 60. However, the thickness of each of the fusible elements 82 and 84 of a 100 empere rated electric fuse 60 can be thicker than that of a fusible element 36 of a 50 ampere rated electric fuse.

Heat absorbing arc-quenching filler material 94 contacts and embeds the middle and left-hand portions of the fusible elements 82, 84. Heat-insulating arc-quenching filler material 96 contacts and embeds the right-hand portions of those fusible elements. Those arc-quenching filler materials preferably are identical, respectively, to the arc-quenching filler materials 56 and 58.

The electric fuse 60 essentially differs from the electric fuse 20 in having a housing with a plurality of passages therethrough whereas the latter electric fuse has just one passage in the housing thereof. The rating of the electric fuse 60 will, of course, be considerably larger than the rating of the electric fuse 20; but it is important to note that no passage in the housing 62 has more than one fusible element therein.

The function and operation of the electric fuse 60 will be similar to the function and operation of the electric fuse 20. However, because the rating of the electric fuse 60 will be greater than that of the electric fuse 20, larger values of current will have to be carried continuously by the electric fuse 60, and larger values of low overcurrents will have to be interrupted by that electric fuse. It should be noted that although the electric fuse 60 must carry more current and must interrupt higher low overcurrents than the electric fuse 20, the former electric fuse has more fusible elements. As a result, the function and operation of each of the fusible elements 82 and 84 of electric fuse 60 will be substantially identical to the function and operation of the fusible element 30 of electric fuse 20.

Where larger ampere rated electric fuses are needed, more than one housing per electric fuse can be provided, as indicated by Fister U.S. Pat. No. 3,938,067. For example, electric fuses in the range from 250 to 400 amperes will have two housings, and each housing will have three passages therein. Each of the consequent six passages will have a fusible element therein; and the differences between the ratings of electric fuses in that ampere range will be attained by varying the thicknesses of those fusible elements. For electric fuses in the range from 450 to 600 amperes, each fuse will have three housings, and each housing will have three passages therein. Each of the consequent nine passages will have a fusible element therein; and the differences in the ratings of electric fuses in that ampere range will be attained by varying the thicknesses of those fusible elements. For electric fuses in the range from 700 to 800 amperes, each fuse will have five housings and each housing will have three passage therein. Each of the consequent 15 passages will have a fusible element therein; and the differences in the ratings of electric fuses in that ampere range will be attained by varying the thicknesses of those fusible elements. For electric fuses in the range from 900 to 1,000 amperes, each fuse will have six housings and each housing will have three passages therein. Each of the consequent 18 passages will have a fusible element therein; and the differences in the ratings of electric fuses in that ampere range will be attained by varying the thicknesses of those fusible elements.

Figure 8:
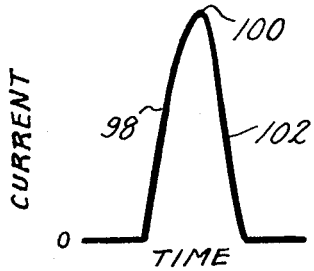
FIG. 8 is a current-time graph which shows a waveform that is produced by a 400 ampere 700 volt electric fuse of the present invention when it fuses.

Referring particularly to FIG. 8, the numeral 98 denotes the rising portion of a curve which represents the current that flows through a four hundred ampere seven hundred volt electric fuse of the present invention when a short circuit is applied to that electric fuse by a capacitor bank. The portion 98 is essentially a straight line, and it rises at an angle which is only about eleven degrees from the vertical. The numeral 100 denotes the upper portion of that curve, and the numeral 102 denotes the falling portion of that curve. That falling portion is essentially a straight line and it falls at an angle which is only about 10° from the vertical, and hence that falling portion is closer to the vertical than is the falling portion of the curve of any prior electric fuse of similar voltage and current-carrying capacity. Because that four hundred ampere seven hundred volt electric fuse provides such a generally straight, sharply-inclined, falling portion for the curve of FIG. 8, that electric fuse is very useful in protecting a semi-conductor against damage.

Figure 9:
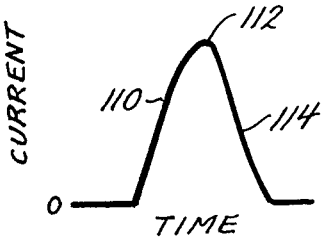
FIG. 9 is a current-time graph which shows a waveform that is produced by a 600 ampere 700 volt electric fuse of the present invention when it fuses.

Referring particularly to FIG. 9, the numeral 110 denotes the rising portion of a curve which represents the current that flows through a 600 ampere 700 volt electric fuse of the present invention when a short circuit is applied to that electric fuse by a capacitor bank. The portion 110 is essentially a straight line, and it rises at an angle which is only about 22° from the vertical. The numeral 112 denotes the upper portion of that curve, and numeral 114 denotes the falling portion of that curve. That falling portion is essentially a straight line and it falls at an angle which is only about fourteen degrees from the vertical, and hence that falling portion is closer to the vertical than is the falling portion of the curve of any prior electric fuse of similar voltage and current-carrying capacity. Because that 600 ampere 700 volt electric fuse provides such a generally straight, sharply-inclined, falling portion for the curve of FIG. 9, that electric fuse is very useful in protecting a semi-conductor against damage.

The clearing time indicated by FIG. 8 is just two milliseconds, and the clearing time indicated by FIG. 9 is just 3 milliseconds. Those clearing times, and the clearing times of all other electric fuses of the present invention, are shorter than the clearing times of any prior electric fuses of comparable ampere and voltage ratings. In fact, the clearing times of some of the electric fuses of the present invention are as much as 30 percent shorter than the clearing times of any prior electric fuses of comparable ampere and voltage ratings. The resulting shorter times during which semi-conductors, which are protected by electric fuses of the present invention, can be subjected to overcurrents decrease the likelihood of injury to those semi-conductors.

The fusible elements, of the various embodiments of electric fuses provided by the present invention, preferably are made from silver. However, if desired, those fusible elements could be made from copper or some other highly-conductive metal or could be made from a highly-conductive alloy.

The electric fuses shown in the drawing have the terminals thereof equipped with knife blades. However, in those ampere ratings where Underwriters Laboratories, Inc., does not require fuse terminals to be equipped with knife blades, the electric fuses of the present invention could be equipped with ferrule-type terminals.

Figure 2:
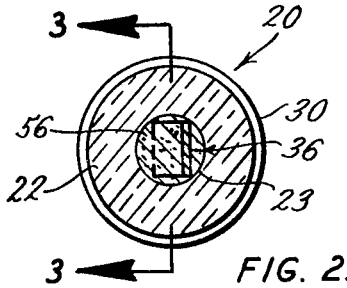
FIG. 2 is a sectional view, on a larger scale, through the electric fuse of FIG. 1, and it is taken along the plane indicated by the line 2—2 in FIG. 1.

The housing 22 of FIGS. 1–3 has just one passage therethrough, and the housing 62 of FIGS. 6 and 7 has just three passages therethrough. An electric fuse that has a large ampere rating could have two or more housings, each of which has three passages therethrough, or it could have a single larger-diameter housing with more than three passages therethrough. The surface-to-volume ratio of such a larger-diameter housing would, of course, be smaller than the surface-to-volume ratios of the smaller-diameter three-passage housings of that large ampere rating fuse. However, if the performance parameters desired for a large ampere rating fuse would permit, a single larger-diameter housing with many more than three passages therethrough could be used.

The fusible element 36 is used in both of the electric fuses shown in the drawing; and both of those electric fuses are intended to protect semiconductors which are incorporated into 700 volt electric circuits. That fusible element would also be useful in electric fuses that were intended to protect semiconductors which were incorporated into six hundred volt electric circuits, although one of the weak spots 40 or 46 would probably be deleted. However, fusible elements other than the fusible element 36 could be used in electric fuses of the present invention which were to be incorporated into 700 volt and 600 volt electric circuits. Any such other fusible elements would, however, have to be bent to dispose axially-displaced portions thereof in intimate heat-transferring relation with one side of the passage and to dispose an intermediate portion thereof in intimate heat-transferring relation with the opposite side of that passage; and the ratio of the cross section of that passage to the cross section of the smallest weak spot of that fusible element would have to be between three hundred and thirty-six hundred to one.

Where the electric fuse of the present invention was made to be incorporated into a 500 volt circuit, a fusible element of the type shown in FIG. 28 of Aldino J. Gaia application Ser. No. 511,059 for PROTECTOR FOR ELECTRIC CIRCUIT which was filed Oct. 1, 1974 could be used. Where the electric fuse of the present invention was made to be incorporated into a 250 volt or a one hundred and thirty volt circuit, a fusible element of the type shown in FIG. 1 of said Gaia application could be used. However, each of those fusible elements would have to be bent to dispose axially-displaced portions thereof in intimate heat-transferring relation with one side of the passage and to dispose an intermediate portion thereof in intimate heat-transferring relation with the opposite side of that passage; and the ratio of the cross section of that passage to the cross section of the smallest weak spot of that fusible element would have to be between three hundred and thirty-six hundred to one.

Where the electric fuses of the present invention are made to be incorporated into a 250 volt or a 130 volt circuit, the yieldable annular seals 29 and 31 of FIGS. 1–3 and the yieldable annular seals 73 and 75 of FIGS. 6 and 7 can be deleted. Also, in some instances where the electric fuses of the present invention are made to be incorporated into a five hundred volt electric circuit, whose yieldable annular seals may be deleted. However, care must be taken to provide good mechanical connections between the terminals and the housings of such electric fuses without degrading the mechanical strengths of those housings or terminals.

The passages 23, 64, 66 and 68 have been shown as being circular in cross section. However, if desired, each of those passages could be acircular in cross section; but the cross sections of those passages should be such that no fusible element could ever abut a side of any passage in face-to-face relation across the full width of that fusible element.

Whereas the drawing and accompanying description have shown and described two preferred embodiments of the present invention it should be apparent to those skilled in the art that various changes may be made in the form of the invention without affecting the scope thereof.

What I claim is:

1. An electric fuse which is adapted to carry its rated current continuously but which is adapted to open the circuit, of which it is a part, in response to a relatively-low overcurrent or to a short circuit and which comprises a housing made from an inorganic ceramic material that has a thermal conductivity greater than seven thousandths of a calorie per square centimeter of cross section per centimeter of length per second of time per ° C., said housing having a passage therethrough, a terminal which is secured to said housing and which closes one end of said passage, a second terminal which is secured to said housing and which closes the other end of said passage, an elongated fusible element which is disposed within said passage, said fusible element having one end thereof electrically connected to the first said terminal, said fusible element having the other end thereof electrically connected to said second terminal, said fusible element having a plurality of longitudinally displaced weak spots therein, one of said weak spots being adjacent said first said terminal so appreciable portions of the heat generated by said one weak spot can be absorbed by said first said terminal, another of said weak spots being adjacent said second terminal so appreciable portions of the heat generated by said other weak spot can be absorbed by said second terminal, heat-absorbing filler material contacting and embedding said one weak spot and adjacent portions of the length of said fusible element so appreciable amounts of the heat generated by said one weak spot in response to said relatively-low overcurrent will be absorbed by said heat-absorbing filler material, and heat-insulating filler material contacting and embedding said other weak spot and adjacent portions of the length of said fusible element so appreciable amounts of the heat generated by said other weak spot in response to said relatively-low overcurrent will not be absorbed by said heat-insulating filler material, said other weak spot being so dimensioned relative to said one weak spot that said appreciable amounts of heat generated by said other weak spot and not absorbed by said heat-insulating filler material will make the temperature of said other weak spot higher than or equal to the temperature of said one weak spot which has had appreciable amounts of heat generated thereby absorbed by said heat-absorbing filler material, and hence will cause said other weak spot to fuse prior to or simultaneously with the fusing of said one weak spot, said fusible element being free of alloying material thereon so it will respond to said relatively-low overcurrent or to a short circuit to raise the temperature of said other weak spot to the fusing temperature of the metal of said fusible element, said fusible element having said one weak spot and said other weak spot spaced inwardly from the elongated edges thereof, said fusible element having longitudinally-displaced portions of said elongated edges thereof disposed in heat-transferring relation with the surface of said passage to enable said housing to absorb heat from portions of said fusible element without directly contacting said weak spots, and thereby enabling said weak spots to generate more heat without fusing than they could if said longitudinally-displaced portions of said elongated edges thereof did not engage said surface of said passage.

2. An electric fuse which is adapted to open the circuit, of which it is a part, in response to a relatively-low overcurrent or to a short circuit and which comprises a housing made from insulating material, said housing having a passage therethrough, a terminal which is secured to said housing and which closes one end of said passage, a second terminal which is secured to said housing and which closes the other end of said passage, an elongated fusible element which is disposed within said passage, said fusible element having one end thereof electrically connected to the first said terminal, said fusible element having the other end thereof electrically connected to said second terminal, said fusible element having a plurality of longitudinally displaced weak spots therein, one of said weak spots being adjacent said first said terminal so appreciable portions of the heat generated by said one weak spot can be absorbed by said first said terminal, another of said weak spots being adjacent said second terminal so appreciable portions of the heat generated by said other weak spot can be absorbed by said second terminal, heat-absorbing filler material contacting and embedding said one weak spot and adjacent portions of the length of said fusible element so appreciable amounts of the heat generated by said one weak spot in response to said relatively-low overcurrent will be absorbed by said heat-absorbing filler material, and heat-insulating filler material contacting and embedding said other weak spot and adjacent portions of the length of said fusible element so appreciable amounts of the heat generated by said other weak spot in response to said relatively-low overcurrent will not be absorbed by said heat-insulating filler material, said other weak spot being so dimensioned relative to said one weak spot that said appreciable amounts of heat generated by said other weak spot and not absorbed by said heat-insulating filler material will make the temperature of said other weak spot higher than or equal to the temperature of said one weak spot which has had appreciable amounts of heat generated thereby absorbed by said heat-absorbing filler material, and hence will cause said other weak spot to fuse prior to or simultaneously with the fusing of said one weak spot, said fusible element being free of alloying material thereon which could respond to heating of said fusible element to alloy with the metal of said fusible element and cause said fusible element to fuse at a temperature below the fusing temperature of said metal, whereby said fusible element will respond to said relatively-low overcurrent or to a short circuit to raise the temperature of said other weak spot to said fusing temperature of said metal.

3. An electric fuse as claimed in claim 2 wherein at least one portion of said fusible element engages the surface of said passage to transfer heat from said fusible element to said housing of insulating material, said one portion of said fusible element not being said one or said other weak spot.

4. An electric fuse as claimed in claim 2 wherein said insulating material of which said housing is made is an inorganic ceramic material that has a thermal conductivity greater than seven thousandths of a calorie per square centimeter of cross section per centimeter of length per second of time per degree centigrade, and wherein at least one portion of said fusible element engages the surface of said passage to transfer heat from said fusible element to said housing of insulating material, said one portion of said fusible element not being said one or said other weak spot.

5. An electric fuse which is adapted to open the circuit, of which it is a part, in response a relatively-low overcurrent or to a short circuit and which comprises a housing made from an inorganic ceramic material that has a thermal conductivity greater than seven thousandths of a calorie per square centimeter of cross section per centimeter of length per second of time per degree centigrade, said housing having a passage therethrough, a terminal which is secured to said housing and which closes one end of said passage, a second terminal which is secured to said housing and which closes the other end of said passage, an elongated fusible element which is disposed within said passage, said fusible element having one end thereof electrically connected to the first said terminal, said fusible element having the other end thereof electrically connected to said second terminal, said fusible element having a plurality of longitudinally displaced weak spots therein, one of said weak spots being adjacent said first said terminal so appreciable portions of the heat generated by said one weak spot can be absorbed by said first said terminal, another of said weak spots being adjacent said second terminal so appreciable portions of the heat generated by said other weak spot can be absorbed by said second terminal, said fusible element having elongated edges that have physically-displaced portions thereof disposed in intimate heat-transferring relation with physically-displaced areas of the surface of said passage to enable said housing to absorb heat from said physically-displaced portions of said elongated edges of said fusible element, said one and said other weak spots being physically displaced from but being in heat-transferring relation with said physically-displaced portions of said elongated edges of said fusible element and thereby enabling said physically-displaced portions of said elongated edges of said fusible element to cause said housing to absorb heat from said one and said other weak spots without actually being in contact with said one and said other weak spots, whereby said one and said other weak spots can generate more heat without fusing than they could if said physically-displaced portions of said elongated edges of said fusible element were not in intimate heat-transferring relation with said physically-displaced areas of said surface of said passage.

6. An electric fuse as claimed in claim 5 wherein said fusible element essentially defines a plane that is parallel to but is radially displaced from the axis of said passage, wherein said plane is immediately adjacent one side of said passage, wherein said fusible element has a portion thereof that is inclined to said plane and that passes through said axis of said passage to dispose a part thereof immediately adjacent the opposite side of said passage, and wherein said fusible element has a further portion thereof that is inclined to said plane and that passes through said axis of said passage to dispose a part thereof immediately adjacent said opposite side of said passage.

7. An electric fuse as claimed in claim 5 wherein said fusible element essentially defines a plane that is parallel to but is radially displaced from the axis of said passage, wherein said plane is immediately adjacent one side of said passage, wherein said fusible element has a portion thereof that is inclined to said plane and that passes through said axis of said passage to dispose a part thereof immediately adjacent the opposite side of said passage, wherein said fusible element has a further portion thereof that is inclined to said plane and that passes through said axis of said passage to dispose a part thereof immediately adjacent said opposite side of said passage, wherein said parts of said inclined portions of said fusible element are contiguous and constitute a re-entrant bend, and wherein the bends at the ends of said inclined portions of said fusible element enable said inclined portions to accommodate heat-induced elongation of said fusible element.

8. An electric fuse as claimed in claim 5 wherein heat-absorbing filler material contacts and embeds said one weak spot and adjacent portions of the length of said fusible element so appreciable amounts of the heat generated by said one weak spot in response to said relatively-low overcurrent will be absorbed by said heat-absorbing filler material, and wherein heat-insulating filler material contacts and embeds said other weak spot and adjacent portions of the length of said fusible element so appreciable amounts of the heat generated by said other weak spot in response to said relatively-low overcurrent will not be absorbed by said heat-insulating filler material, and wherein said other weak spot is so dimensioned relative to said one weak spot that said appreciable amounts of heat generated by said other weak spot and not absorbed by said heat-insulating filler material will make the temperature of said other weak spot higher than or equal to the temperature of said one weak spot which has had appreciable amounts of heat generated thereby absorbed by said heat-absorbing filler material, and hence will cause said other weak spot to fuse prior to or simultaneously with the fusing of said one weak spot.

9. An electric fuse as claimed in claim 5 wherein at least some of said physically-displaced portions of said elongated edges of said fusible element are generally in register with and are close to said one and said other weak spots.

10. An electric fuse which is adapted to open the circuit, of which it is a part, in response to a relatively-low overcurrent or to a short circuit and which comprises a housing made from an inorganic ceramic material that has a thermal conductivity greater than seven thousandths of a calorie per square centimeter of cross section per centimeter of length per second of time per degree centigrade, said housing having a passage therethrough, a terminal which is secured to said housing and which closes one end of said passage, a second terminal which is secured to said housing and which closes the other end of said passage, an elongated fusible element which is disposed within said passage, said fusible element having one end thereof electrically connected to the first said terminal, said fusible element having the other end thereof electrically connected to said second terminal, said fusible element having a plurality of longitudinally displaced weak spots therein, one of said weak spots being adjacent said first said terminal so appreciable portions of the heat generated by said one weak spot can be absorbed by said first said terminal, another of said weak spots being adjacent said second terminal so appreciable portions of the heat generated by said other weak spot can be absorbed by said second terminal, said fusible element having a portion thereof which is intermediate said weak spots and which is disposed in intimate heat-transferring relation with said passage whereby said weak spots can generate more heat without fusing than they could if said portion of said fusible element was not in intimate heat-transferring relation with said passage, and arc-quenching filler material within said passage which contacts and embeds said fusible element.

11. An electric fuse which is adapted to open the circuit, of which it is a part, in response to a relatively-low overcurrent or to a short circuit and which comprises a housing made from an insulating material, said housing having a passage therethrough, a terminal which is secured to said housing and which closes one end of said passage, a second terminal which is secured to said housing and which closes the other end of said passage, an elongated fusible element which is disposed within said passage, said fusible element having one end thereof electrically connected to the first said terminal, said fusible element having the other end thereof electrically connected to said second terminal, said fusible element having a plurality of longitudinally displaced weak spots therein, said fusible element having the major portion of the length thereof disposed in intimate heat-transferring relation with one side of said passage, and said fusible element having a further portion of the length thereof disposed in intimate heat-transferring relation with the opposite side of said passage, whereby both said one and said opposite sides of said housing of insulating material can absorb heat from said fusible element to enable the cross-sections of said weak spots to be smaller than they would have to be if said major portion of said length of said fusible element was not disposed in intimate heat-transferring relation with said one side of said passage and if said further portion of said length of said fusible element was not disposed in intimate heat-transferring relation with said opposite side of said passage.

12. An electric fuse as claimed in claim 11 wherein said housing is made from an inorganic ceramic material that has a thermal conductivity greater than thirty thousandths of a calorie per square centimeter of cross section per centimeter of length per second of time per degree centigrade.

13. An electric fuse as claimed in claim 11 wherein said major portion of the length of said fusible element normally touches said one side of said passage but responds to heat-induced elongation of said fusible element to touch said one side of said passage even more intimately, and wherein said further portion of said fusible element normally touches said opposite side of said passage but responds to heat-induced elongation of said fusible element to touch said opposite side of said passage even more intimately.

14. An electric fuse which is adapted to open the circuit, of which it is a part, in response to a relatively-low overcurrent or to a short circuit and which comprises a housing made from an inorganic ceramic material, said housing having a passage therethrough, a terminal which is secured to said housing and which closes one end of said passage, a second terminal which is secured to said housing and which closes the other end of said passage, an elongated fusible element which is disposed within said passage, said fusible element having one end thereof electrically connected to the first said terminal, said fusible element having the other end thereof electrically connected to said second terminal, said fusible element having a plurality of longitudinally displaced weak spots therein, one of said weak spots being adjacent said first said terminal so appreciable portions of the heat generated by said one weak spot can be absorbed by said first said terminal, another of said weak spots being adjacent said second terminal so appreciable portions of the heat generated by said other weak spot can be absorbed by said second terminal, said fusible element having a portion thereof which is intermediate said weak spots and which is disposed in intimate heat-transferring relation with said passage whereby said weak spots can generate more heat without fusing than they could if said portion of said fusible element was not in intimate heat-transferring relation with said passage, and arc-quenching filler material within said passage which contacts and embeds said fusible element, a further weak spot located between said one weak spot and said intermediate portion of said fusible element which has a cross section larger than that of said one weak spot, a still further weak spot located between said other weak spot and said intermediate portion of said fusible element which has a cross section larger than that of said other weak spot, said one and said other weak spots fusing before said further and said still further weak spots can fuse despite the absorption by said terminals from said one and said other weak spots of said appreciable portions of the heat generated by said one and said other weak spots.

15. An electric fuse as claimed in claim 14 wherein said housing is made from a material of the class consisting of aluminum oxide, beryllium oxide and boron nitride.

* * * * *